US009196194B2

(12) United States Patent
Song

(10) Patent No.: US 9,196,194 B2
(45) Date of Patent: Nov. 24, 2015

(54) TIMING CONTROLLER OF DISPLAY DEVICE AND METHOD FOR DRIVING THE SAME

(71) Applicant: Samsung Display Co., Ltd., Yongin, Gyeonggi-Do (KR)

(72) Inventor: Seock-Cheon Song, Yongin (KR)

(73) Assignee: Samsung Display Co., Ltd., Samsung-ro, Gibeung-Gu, Yongin-si, Gyeonggi-Do (KR)

( * ) Notice: Subject to any disclaimer, the term of this patent is extended or adjusted under 35 U.S.C. 154(b) by 118 days.

(21) Appl. No.: 13/937,935

(22) Filed: Jul. 9, 2013

(65) Prior Publication Data

US 2014/0198139 A1 Jul. 17, 2014

(30) Foreign Application Priority Data

Jan. 16, 2013 (KR) ..... 10-2013-0005050

(51) Int. Cl.
*G09G 5/10* (2006.01)
*G09G 3/32* (2006.01)

(52) U.S. Cl.
CPC ..... *G09G 3/3208* (2013.01)

(58) Field of Classification Search
CPC ..... G09G 3/3208
USPC ..... 345/14, 24, 60–85, 173, 208, 211, 545, 345/690–698; 351/221; 396/155; 235/454, 235/462.45; 348/446
See application file for complete search history.

(56) References Cited

U.S. PATENT DOCUMENTS

| | | | | |
|---|---|---|---|---|
| 4,677,431 | A * | 6/1987 | Lee | 345/24 |
| 6,014,125 | A * | 1/2000 | Herbert | 345/660 |
| 6,072,530 | A * | 6/2000 | Bril | 348/447 |
| 6,154,189 | A * | 11/2000 | Tamura et al. | 345/89 |
| 7,786,967 | B2 | 8/2010 | Kim et al. | |
| 8,125,424 | B2 | 2/2012 | Hong et al. | |
| 2006/0153558 | A1 * | 7/2006 | Tan et al. | 396/155 |
| 2007/0018919 | A1 * | 1/2007 | Zavracky et al. | 345/87 |
| 2007/0139339 | A1 | 6/2007 | Kim et al. | |
| 2008/0136756 | A1 | 6/2008 | Yeo et al. | |
| 2009/0146984 | A1 * | 6/2009 | Bae et al. | 345/208 |
| 2011/0074660 | A1 * | 3/2011 | Hajjar et al. | 345/75.1 |
| 2011/0115729 | A1 * | 5/2011 | Kremin et al. | 345/173 |
| 2011/0169797 | A1 * | 7/2011 | Song et al. | 345/209 |
| 2011/0273408 | A1 | 11/2011 | Ra et al. | |

(Continued)

FOREIGN PATENT DOCUMENTS

| | | | |
|---|---|---|---|
| KR | 10-2007-0065701 | A | 6/2007 |
| KR | 10-2008-0053598 | A | 6/2008 |
| KR | 10-2011-0123529 | A | 11/2011 |

*Primary Examiner* — Prabodh M Dharia
(74) *Attorney, Agent, or Firm* — Robert E. Bushnell, Esq.

(57) ABSTRACT

In a timing controller capable of decreasing flicker of an image to be displayed and a method of driving the same, the timing controller includes: a timing signal generator outputting a scan starting signal and clock signals to a scan driving unit; a sensing unit sensing status transition time points of the scan starting signal and the scan signal outputted from the scan driving unit for a plurality of frame periods; an estimator estimating a delay value and a jitter value with respect to the status transition time points; and an off-set signal generator generating an off-set signal for controlling the scan starting signal or the clock signals based on the delay value and the jitter value. The timing signal generator, in response to the off-set signal, regulates timings of the scan starting signal and the clock signals.

16 Claims, 3 Drawing Sheets

(56) References Cited

U.S. PATENT DOCUMENTS

2012/0169660 A1* 7/2012 Seo ..... 345/174
2012/0169801 A1* 7/2012 Lee et al. ..... 345/691
2012/0320112 A1* 12/2012 Hagood et al. ..... 345/690
2013/0057763 A1 3/2013 Cha et al.
2013/0141479 A1* 6/2013 Choi ..... 345/691

* cited by examiner

TIMING CONTROLLER OF DISPLAY DEVICE AND METHOD FOR DRIVING THE SAME

CLAIM OF PRIORITY

This application makes reference to, incorporates into this specification the entire contents of, and claims all benefits accruing under 35 U.S.C. §119 from an application earlier filed in the Korean Intellectual Property Office filed on Jan. 16, 2013 and there duly assigned Serial No. 10-2013-0005050.

BACKGROUND OF THE INVENTION

1. Field of the Invention

The present invention relates to a timing controller included in a display, and more particularly, to a timing controller capable of decreasing flicker of an image to be displayed and a method of driving the same.

2. Description of the Related Art

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by re-combination of electrons and holes. The organic light emitting display has high response speed and is driven with low power consumption.

The existing organic light emitting display device includes a data driving unit for supplying data signals to data lines, a scan driving unit for sequentially supplying scan signals to scan lines, a pixel unit having pixels arranged at every intersections between the scan lines, and a timing controller for controlling operations of the data driving unit and the scan driving unit.

When the scan signals are supplied, the pixels charge voltage corresponding to the data signals supplied through the data lines storage capacitors included in the respective pixels and supply current corresponding to the charged voltage to organic light emitting diodes so as to emit light of brightness corresponding to the data signals.

In the existing organic light emitting display device, the timing of a scan starting signal outputted to the scan driving unit by the timing controller and the timing of the scan signals outputted from the scan driving unit may vary based on temperature and external environmental changes. Since the pixels cannot be supplied with the data signals precisely when the timing variation of the scan signals is out of an allowed range, for example, since the pixels cannot be supplied with the data signals which have to be supplied to adjacent pixels, flickers may appear in an image to be displayed.

SUMMARY OF THE INVENTION

Accordingly, the present invention has been developed to provide a timing controller capable of reducing flicker of an image to be displayed, even when internal or external environmental conditions are changed, and a method of driving the same.

In order to achieve the foregoing and/or other aspects of the present invention, there is provided a timing controller, including: a timing signal generator outputting a scan starting signal and clock signals to a scan driving unit; a sensing unit sensing status transition time points of the scan starting signal and the scan signal outputted from the scan driving unit for a plurality of frame periods; an estimator estimating a delay value and a jitter value with respect to the status transition time points; and an off-set signal generator generating an off-set signal for controlling the scan starting signal or the clock signals based on the delay value and the jitter value; wherein, in response to the off-set signal, the timing signal generator regulates the timing of the scan starting signal and the timing of the clock signals.

According to an embodiment of the present invention, the timing signal generator may include: a controlling unit which, in response to the off-set signal, outputs a scan control signal for regulating a timing of the scan starting signal and a clock control signal for regulating a timing of the clock signals; a scan starting signal generating unit which, in response to the scan control signal, regulates the timing of the scan starting signal and outputs the regulated timing to the scan driving unit; and a clock signal generating unit which, in response to the clock control signal, regulates the timing of the clock signals and outputs the regulating timings thereof to the scan driving unit.

According to an embodiment of the present invention, the status transition time points may include rising edge time points and lowering edge time points.

According to an embodiment of the present invention, each of the delay values may be an average value of differences between the status transition time points and a reference time point.

According to an embodiment of the present invention, each of the jitter values may be an absolute value of the largest one of differences between the status transition time points and a reference time point.

According to an embodiment of the present invention, the off-set signal may be any one of a delay off-set signal, a jitter off-set signal, and a signal continuing signal off-set signal.

According to an embodiment of the present invention, the delay off-set signal may correspond to a difference between a delay value of lowering edge time points of the scan starting signal and a delay value of lowering edge time points of the scan signal.

According to an embodiment of the present invention, the jitter off-set signal may correspond to a jitter value of the scan starting signal or a jitter value of the scan signal.

According to an embodiment of the present invention, the signal continuing signal off-set signal may correspond to a difference between a delay value of rising edge time points and a delay value of lowering edge time points of the scan signal.

The present invention also provides a method of driving a timing controller, including: sensing status transition time points of a scan starting signal outputted from a scan driving unit and a scan signal outputted from the scan driving unit for a plurality of frame periods; estimating delay values and jitter values with respect to the status transition time points for the plurality frame periods; and regulating timings of the scan signal or clock signals outputted to the scan driving unit based on the delay values and the jitter values.

According to an embodiment of the present invention, the status transition time points may include rising edge time points and lowering edge time points.

According to an embodiment of the present invention, each of the delay values may be an average value of differences between the status transition time points and a reference time point.

According to an embodiment of the present invention, the jitter values may be an absolute value of the largest one of differences between the status transition time points and a reference time point.

According to an embodiment of the present invention, the regulating of timings may include: generating a delay off-set signal corresponding to a difference between a delay value of lowering edge time points of the scan starting signal and a delay value of lowering edge time points of the scan signal; and regulating timing of the scan signal or clock signals outputted to the scan driving unit in response to the delay off-set signal.

According to an embodiment of the present invention, the regulating of timings may include: generating a jitter off-set signal corresponding to a jitter value of the scan starting signal or a jitter value of the scan signal; and regulating timings of the scan signal or clock signals outputted to the scan driving unit in response to the jitter off-set signal.

According to an embodiment of the present invention, the regulating of timings may include: generating a signal continuing time off-set signal corresponding to a difference between a delay value of lowering edge time points and a delay value of rising edge time points of the scan signal; and regulating timing of the scan signal or clock signals outputted to the scan driving unit in response to the signal continuing time off-set signal.

According to the present invention and the method of driving the same, the scan starting signal outputted to the scan driving unit and at least one of the scan signals outputted from the scan driving unit is fed back to regulate timings of the scan starting signal or the clock signals so that flicker of an image to be displayed can be reduced, even when the internal or external environment is changed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
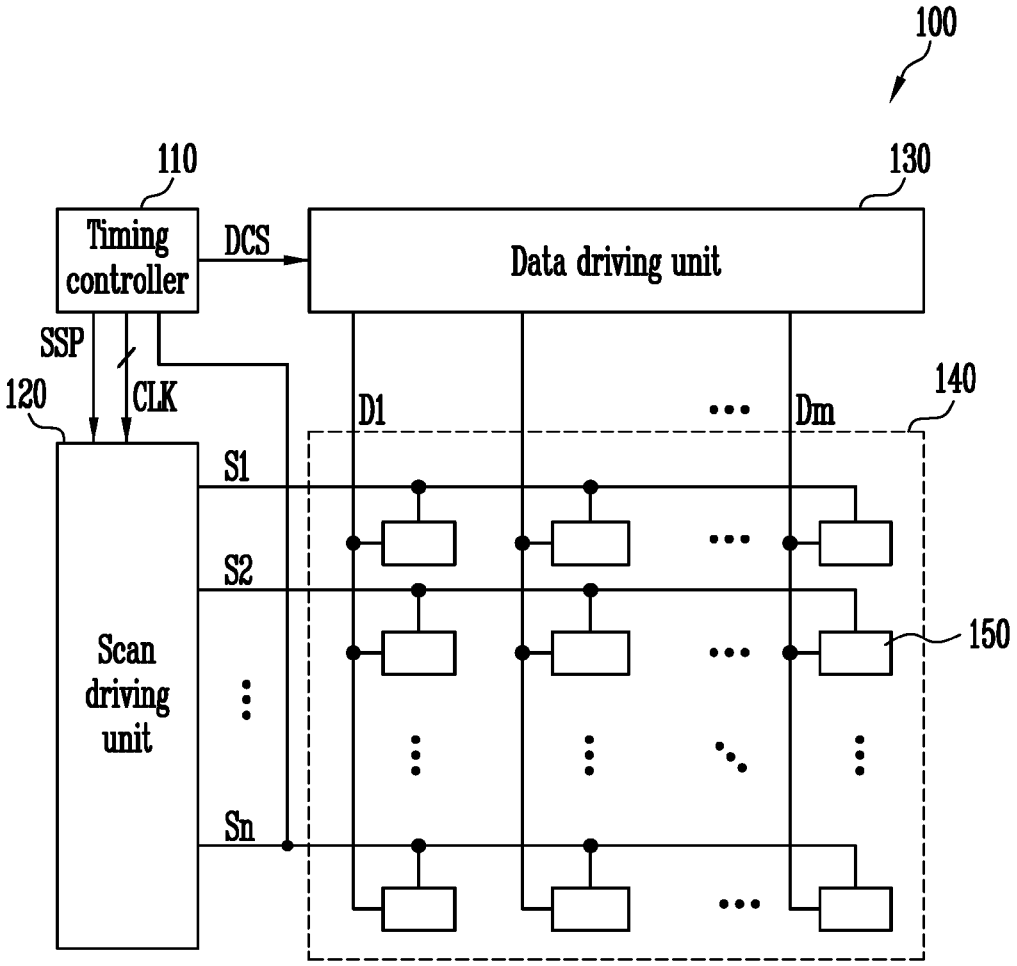
FIG. 1 is a view illustrating an organic light emitting display device according to an embodiment of the present invention.

Hereinafter, certain exemplary embodiments according to the present invention will be described with reference to the accompanying drawings. Here, when a first element is described as being coupled to a second element, the first element may not only be directly coupled to the second element but may also be indirectly coupled to the second element via a third element. Furthermore, some of the elements that are not essential to a complete understanding of the invention are omitted for clarity. Also, like reference numerals refer to like elements throughout.

Hereinafter, a timing controller and a method of driving the same will be described in detail as follows with reference to FIGS. 1 to 3 in which preferred embodiments by which those skilled in the art may easily perform the present invention are included.

FIG. 1 is a view illustrating an organic light emitting display device according to an embodiment of the present invention. Referring to FIG. 1, an organic light emitting display device 100 includes a timing controller 110, a scan driving unit 120, a data driving unit 130, and a pixel unit 140.

The timing controller 110 controls operations of the scan driving unit 120 and the data driving unit 130 and arranges data supplied from the outside so as to supply the re-arranged data to the data driving unit 130.

The timing controller 110 creates scan driving control signals, for example, scan starting signals SSP and a clock signal CLK, and supplies the created signals to the scan driving unit 120, in response to a synchronization signal supplied from the outside. Moreover, the timing controller 110, in response to the synchronization signal supplied from the outside, creates a data driving control signal DCS and supplies the created data driving control signal DCS together with rearranged data to the data driving unit 130.

The timing controller 110 senses and analyzes the timings of the scan starting signal SSP outputted from the scan driving unit 120 and at least one scan signal outputted from the scan driving unit 120 for a plurality of frame periods, and regulates the timings of the scan starting signal SSP and the clock signals CLK based on the analysis.

Here, the sensing of the timings of the scan starting signals SSP and the scan signals means sensing of status transition time points of the scan starting signals SSP and the scan signals.

FIG. 1 illustrates that the timing controller 110 is connected to the nth scan line Sn for the illustrative purpose, but the spirit of the present invention is not limited thereto. That is, the timing controller 110 may be connected to any one of the scan lines S1 to Sn so as to sense timing of the scan signals outputted through the scan line to which the timing controller 110 is connected.

According to an embodiment of the present invention, the timing controller 110 may be connected to two more of the scan lines S1 to Sn so as to sense the timing of the scan signals supplied through the respective two more scan lines.

Specifically, the timing controller 110 outputs the scan starting signals SSP and the clock signals CLK to the scan driving unit 120. In this case, the scan driving unit 120, in response to the scan starting signals SSP and the clock signals CLK, sequentially outputs the scan signals to the pixel unit 140 through the scan lines S1 to Sn.

The timing controller 110 senses the timings of the scan starting signals SSP and the scan signals outputted through the scan line Sn for a plurality of frame periods, that is, the status transition time point, and estimates a delay value and a jitter value for the status transition time point of the scan starting signals SSP and the scan signals. The timing controller 110 regulates the timing of the scan starting signal SSP and the clock signals CLK based on the estimated delayed value and the estimated jitter value, and outputs the regulated timing to the scan driving unit 120 so as to reduce flicker of an image to be displayed.

Figure 2:
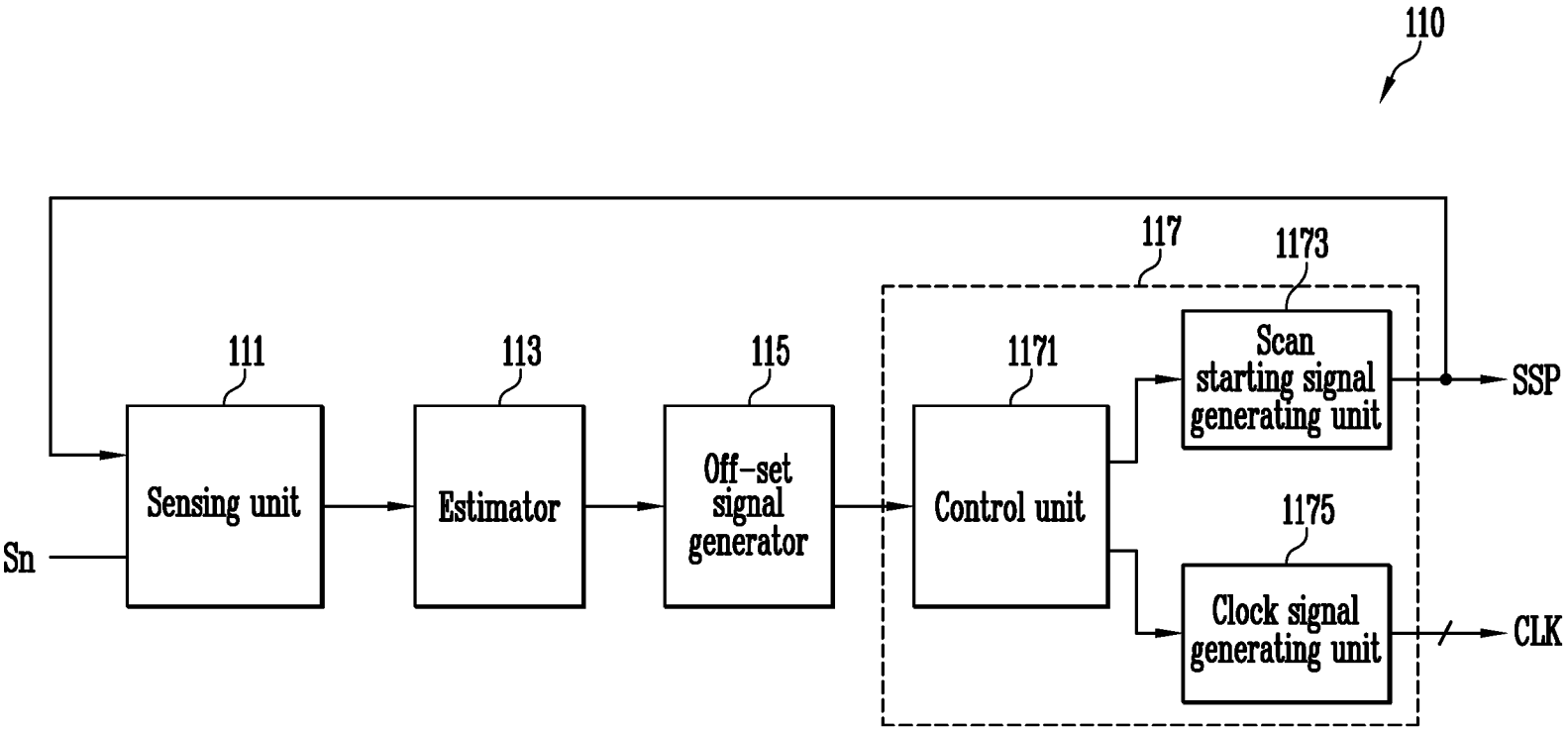
FIG. 2 is a view illustrating an embodiment of a timing controller depicted in FIG. 1.

FIG. 2 is a view illustrating an embodiment of a timing controller depicted in FIG. 1. Referring to FIG. 2, the timing controller 110 includes a sensing unit 111, an estimator 113, an off-set signal generator 115, and a timing signal generator 117.

The sensing unit 111 senses the timing of the scan starting signal SSP outputted from the scan driving unit 120 and the scan signal outputted from the scan driving unit 120 through the scan line Sn for a plurality of frame periods. That is, the sensing unit 111 senses and stores the respective status transition time points of the scan starting signals SSP and the scan signals, for example, lowering edge time points and rising edge time points for a plurality of frame periods.

The estimator 113 estimates the delay values and the jitter values of the scan starting signals SSP and the scan signals with respect to the status transition time points. That is, the estimator 113 estimates the delay values and the jitter values of the scan starting signal SSP with respect to lowering edge time points and rising edge time points and of the scan signal with respect to lowering edge time points and rising edge time points.

Herein the delay value may be an average of differences between the status transition time points and a reference time point while the jitter value may be an absolute value of the largest one of the differences between the status transition time points and the reference time point.

The off-set signal generator 115 generates an off-set signal for controlling the timings of the scan starting signals SSP and the clock signals CLK based on the delay values and the jitter values with respect to the status transition time points estimated by the estimator 113. Here, the off-set signal may be a delay off-set signal, a jitter off-set signal, or a signal continuing time off-set signal.

The delay off-set signal indicates a time difference between the scan starting signal SSP and the scan signal. For example, the delay off-set signal may be a value corresponding to a difference between the delay value of the lowering edge time points of the scan starting signals SSP and the delay value of the lowering edge time points of the scan signals.

The jitter off-set signal indicates a jitter value of the scan starting signal SSP or the scan signal. For example, the jitter off-set signal may be a jitter value of the rising edge time points or the lowering edge time points of the scan starting signal SSP or of the rising edge time points or the lowering edge time points of the scan signal.

The signal continuing time off-set signal indicates time when the scan starting signal SSP is supplied, for example, time maintaining a low level or time when the scan signal is supplied. For example, the signal continuing time off-set signal may be a difference between the delay values of the lowering edge time points and the delay values of the rising edge time points of the scan starting signals SSP, or a value corresponding to a difference between the delay values of the lowering edge time points and the rising edge time points of the scan signal.

The timing signal generator 117, in response to the off-set signal outputted from the off-set signal generator 115, regulates timing of the scan starting signal SSP and the clock signals CLK, and outputs the regulated timings to the scan driving unit 120. The timing signal generator 117 includes a control unit 1171, a scan starting signal generating unit 1173, and a clock signal generating unit 1175.

The control unit 1171, in response to the off-set signal outputted from the off-set signal generator 115, generates a scan control signal for regulating timing of the scan starting signal SSP and a clock control signal for regulating timings of the clock signals CLK. The control unit 1171 outputs the generated scan control signal to the scan starting signal generating unit 1173 and outputs the generated clock control signal to the clock signal generating unit 1175.

The scan starting signal generating unit 1173, in response to the scan control signal outputted from the control unit 1171, regulates the timing of the scan starting signal SSP and outputs the regulated timing to the scan driving unit 120 of FIG. 1. For example, the scan starting signal generating unit 1173 may regulate the status transition time points of the scan starting signals SSP, that is, the rising edge time point and the lower edge time point, and outputs the regulated time points to the scan driving unit 120.

The clock signal generating unit 1175, in response to the clock control signal outputted from the control unit 1171, regulates the timings of the clock signals CLK and outputs the regulated timings to the scan driving unit 120 of FIG. 1. For example, the clock signal generating unit 1175 may regulate frequencies of the clock signals CLK and outputs the regulated frequencies to the scan driving unit 120.

The scan driving unit 120, in response to the scan starting signal SSP and the clock signals CLK outputted from the timing controller 110, supplies the scan signals to the scan lines S1 to Sn sequentially.

Figure 3:
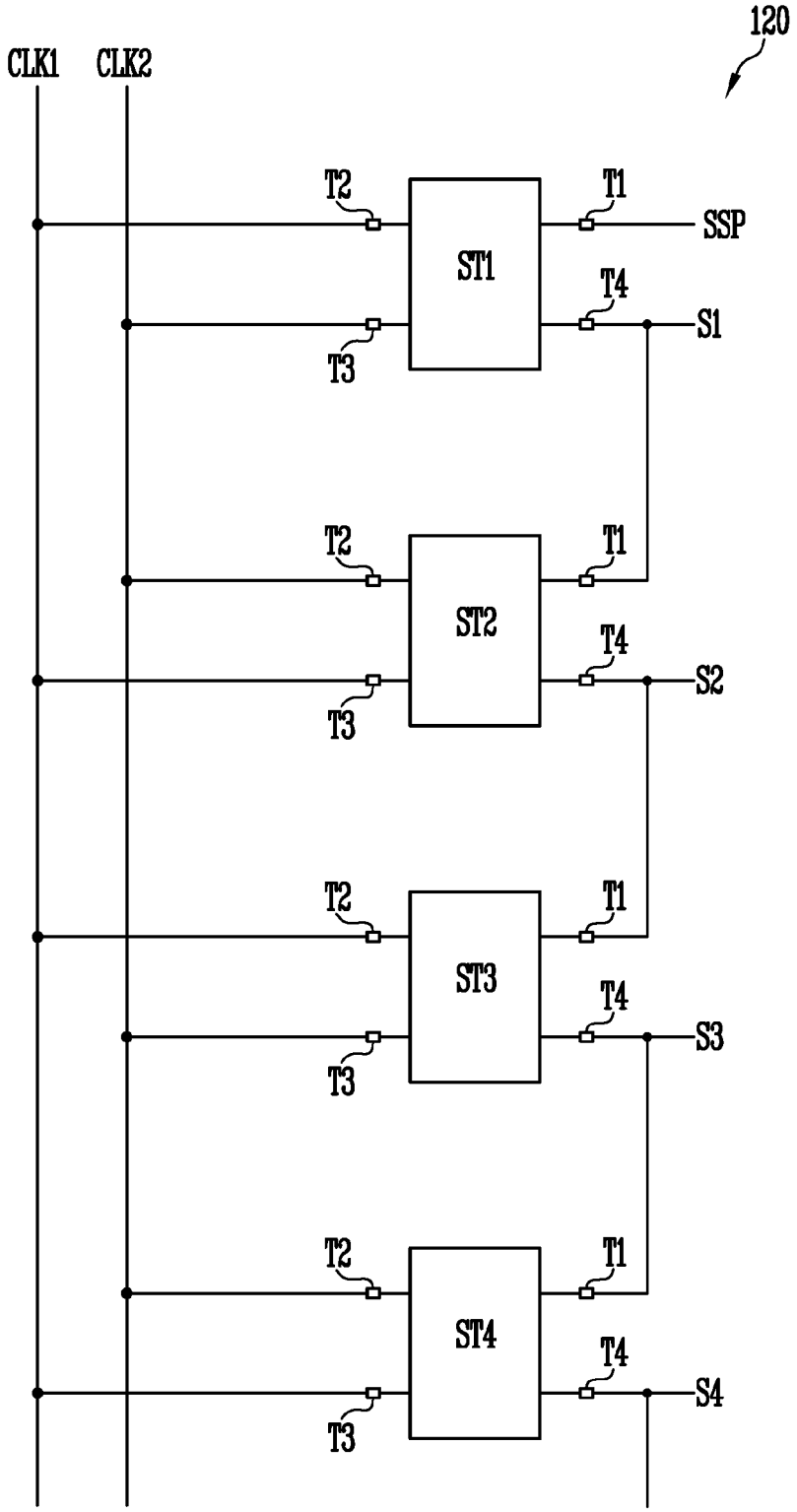
FIG. 3 is a view illustrating an embodiment of a scan driving unit depicted in FIG. 1.

FIG. 3 is a view illustrating an embodiment of a scan driving unit depicted in FIG. 1. FIG. 3 depicts only four stages for illustrative convenience. FIG. 3 depicts a typical structure of the scan driving unit for the illustrative purpose of regulating timings of scan signals according to the scan starting signal SSP and the clock signals CLK, but the present invention is not limited thereto.

Referring to FIG. 3, the scan driving unit 120 includes a plurality of stages ST1 to ST4. Each of the stages ST1 to ST4 is connected to any one of the scan lines S1 to S4, and is driven in correspondence to clock signals CLK1 and CLK2. The stages ST1 to ST4 are configured with an identical circuit.

Each of the stages ST1 to ST4 includes a first input terminal T1, a second input terminal T2, a third input terminal T3, and an output terminal T4.

The first input terminal T1 of each stage ST1 to ST4 is supplied with an output signal of a previous stage, that is, a scan signal or the scan starting signal SSP. For example, the first input terminal T1 of the first stage ST1 is supplied with the scan starting signal SSP and the first input terminals T1 of each of the remaining stages ST2 to ST4 are supplied with the output signal of the previous stage.

The second input terminal T2 of an ith stage STi (i is an odd or even number) is supplied with a first clock signal CLK1 while a third input terminal T3 thereof is supplied with a second clock signal CLK2. The second input terminal T2 of an (i+1)th stage $ST_{i+1}$ is supplied with the second clock signal CLK2 while the third input terminal T3 thereof is supplied with the first clock signal CLK1.

The first clock signal CLK1 and the second clock signal CLK2 have identical phases but are not overlapped with each other. For example, if a time period when a scan signal is supplied to a single scan line is set to a horizontal period 1 H, the clock signals CLK1 and CLK2 have a cycle of 2 H and are supplied in different horizontal periods, respectively.

The spirit of the present invention is not limited to the fact that the clock signals CLK1 and CLK2 have a cycle of 2 H. For example, according to circuit configuration, each of the clock signals CLK1 and CLK2 may have various periods such as 0.5 H, 2 H, and 4 H and have an identical cycle.

The timing controller 110 may regulate the timing of the scan starting signal SSP or frequencies of the clock signals CLK1 and CLK2, and output the regulated timing or frequencies to the scan driving unit 120 so as to regulate timings of the scan signals from the scan driving unit 120 to the scan lines S1 to S4. In this case, the pixels 150 of FIG. 1, in response to the scan signals with the regulated timings, are supplied with the data signal to display an image without flicker.

Referring again to FIG. 1, the data driving unit 130, in response to the data driving control signal DCS outputted from the timing controller 110, outputs data signals to the pixel unit 140 through the data lines D1 to Dm.

The pixel unit 140 includes the pixels 150 arranged at every intersection of the data lines D1 to Dm and the scan lines S1 to Sn. Each of the pixels 150, in response to the scan signal outputted from the scan driving unit 120, charges the storage capacitor included in the pixels 150 with a voltage corresponding to the data signal outputted from the data driving unit 130, and generates light of brightness corresponding to the charged voltage of the storage capacitor. The pixels 150, in response to the scan signals with the regulated timings outputted from the scan driving unit 120, are exactly supplied with the data signals outputted from the data driving unit 130 so as to display an image without flicker.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A timing controller included in a display for controlling the display so as to decrease flicker of an image to be displayed by the display, said timing controller comprising:

a timing signal generator for outputting a scan starting signal and clock signals to a scan driving unit;

a sensing unit for sensing status transition time points of the scan starting signal and the scan signal outputted from the scan driving unit for a plurality of frame periods;

an estimator for estimating a delay value and a jitter value with respect to the status transition time points; and an off-set signal generator for generating an off-set signal for controlling one of the scan starting signal and the clock signals based on the delay value and the jitter value;

wherein the timing signal generator, in response to the off-set signal, regulates timings of the scan starting signal and the clock signals.

2. The timing controller as claimed in claim 1, wherein the timing signal generator comprises:

a controlling unit responsive to the off-set signal for outputting a scan control signal for regulating a timing of the scan starting signal and a clock control signal for regulating a timing of the clock signals;

a scan starting signal generating unit responsive to the scan control signal for regulating the timing of the scan starting signal and for outputting the regulated timing to the scan driving unit; and a clock signal generating unit responsive to the clock control signal for regulating the timings of the clock signals and for outputting the regulating timings thereof to the scan driving unit.

3. The timing controller as claimed in claim 1, wherein the status transition time points include rising edge time points and lowering edge time points.

4. The timing controller as claimed in claim 1, wherein each of the delay values is an average value of differences between the status transition time points and a reference time point.

5. The timing controller as claimed in claim 1, wherein each of the jitter values is an absolute value of the largest one of differences between the status transition time points and a reference time point.

6. The timing controller as claimed in claim 1, wherein the off-set signal is any one of a delay off-set signal, a jitter off-set signal, and a signal continuing signal off-set signal.

7. The timing controller as claimed in claim 6, wherein the delay off-set signal corresponds to a difference between a delay value of lowering edge time points of the scan starting signal and a delay value of lowering edge time points of the scan signal.

8. The timing controller as claimed in claim 6, wherein the jitter off-set signal corresponds to one of a jitter value of the scan starting signal and a jitter value of the scan signal.

9. The timing controller as claimed in claim 6, wherein the signal continuing signal off-set signal corresponds to a difference between a delay value of rising edge time points and a delay value of lowering edge time points of the scan signal.

10. A method of driving a timing controller included in a display for controlling the display so as to decrease flicker of an image to be displayed by the display, said method comprising the steps of:

sensing status transition time points of a scan starting signal outputted from a scan driving unit and a scan signal outputted from the scan driving unit for a plurality of frame periods;

estimating delay values and jitter values with respect to the status transition time points for the plurality frame periods; and regulating timing of one of the scan signal and clock signals outputted to the scan driving unit based on the delay values and the jitter values.

11. The method of driving a timing controller as claimed in claim 10, wherein the status transition time points include rising edge time points and lowering edge time points.

12. The method of driving a timing controller as claimed in claim 10, wherein each of the delay values is an average value of differences between the status transition time points and a reference time point.

13. The method of driving a timing controller as claimed in claim 10, wherein the jitter values are an absolute value of the largest one of differences between the status transition time points and a reference time point.

14. The method of driving a timing controller as claimed in claim 10, wherein the step of regulating timing comprises:

generating a delay off-set signal corresponding to a difference between a delay value of lowering edge time points of the scan starting signal and a delay value of lowering edge time points of the scan signal; and regulating timing of said one of the scan signal and the clock signals outputted to the scan driving unit in response to the delay off-set signal.

15. The method of driving a timing controller as claimed in claim 10, wherein the step of regulating timing comprises:

generating a jitter off-set signal corresponding to one of a jitter value of the scan starting signal and a jitter value of the scan signal; and regulating timing of said one of the scan signal and the clock signals outputted to the scan driving unit in response to the jitter off-set signal.

16. The method of driving a timing controller as claimed in claim 10, wherein the step of regulating timing comprises:

generating a signal continuing time off-set signal corresponding to a difference between a delay value of lowering edge time points and a delay value of rising edge time points of the scan signal; and regulating timing of said one of the scan signal and the clock signals outputted to the scan driving unit in response to the signal continuing time off-set signal.

* * * * *